United States Patent [19]

Schaeffer et al.

[11] Patent Number: 4,924,889

[45] Date of Patent: May 15, 1990

[54] FORM FOR EXTENDING FINGERNAILS AND METHOD OF USING THE SAME

[75] Inventors: George Schaeffer, Los Angeles; William Lawrence, Orange, both of Calif.

[73] Assignee: OPI Products, Inc., North Hollywood, Calif.

[21] Appl. No.: 289,197

[22] Filed: Dec. 23, 1988

[51] Int. Cl.[5] ..... A45D 29/00

[52] U.S. Cl. ..... 132/73

[58] Field of Search ..... 132/73, 285, 320

[56] References Cited

U.S. PATENT DOCUMENTS

| | | | |
|---|---|---|---|
| 2,799,282 | 7/1957 | Slack | 132/285 |
| 3,382,878 | 5/1968 | Dinerstein | 132/285 |
| 3,478,756 | 11/1969 | Sautter et al. | 132/73 |
| 4,643,208 | 2/1987 | Amour | 132/320 |
| 4,682,612 | 7/1987 | Giuliano | 132/73 |

*Primary Examiner*—John J. Wilson
*Assistant Examiner*—Adriene J. Lepiane
*Attorney, Agent, or Firm*—Blakely, Sokoloff Taylor, Zafman

[57] ABSTRACT

A form for providing a support for the application of artificial fingernail material is disclosed herein. The form is generally horseshoe-shaped, the improvement comprising the addition of a lip member on the portion of the platform adjacent to the finger. The lip member provides additional support and attachment sites for the form to the finger and prevents bowing of the form as a result of notches provided on each side of the lip member accommodate folds of skin on the sides of the nail.

6 Claims, 1 Drawing Sheet

FIG. 1 (PRIOR ART)
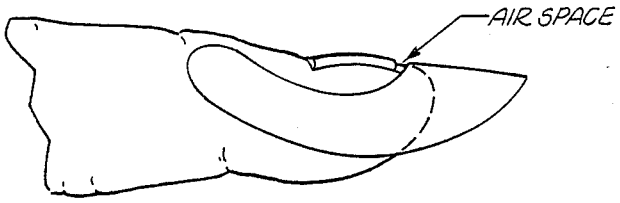
FIG. 1a
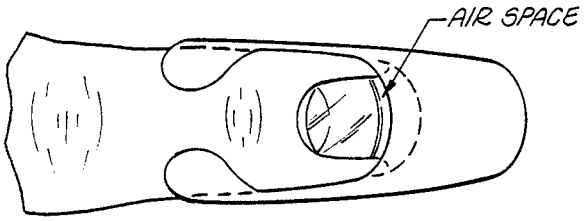
FIG. 1b
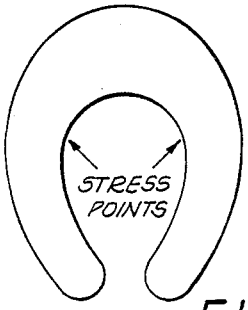
FIG. 1c
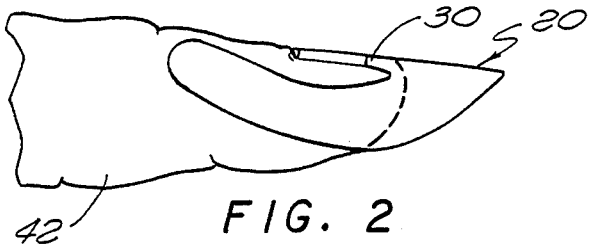
FIG. 2
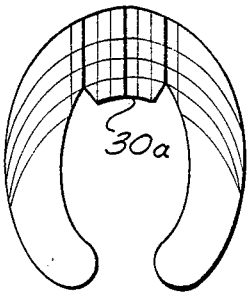
FIG. 5a
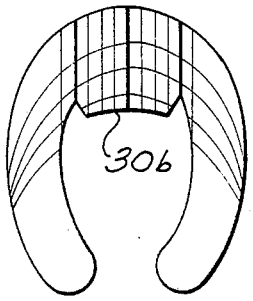
FIG. 5b
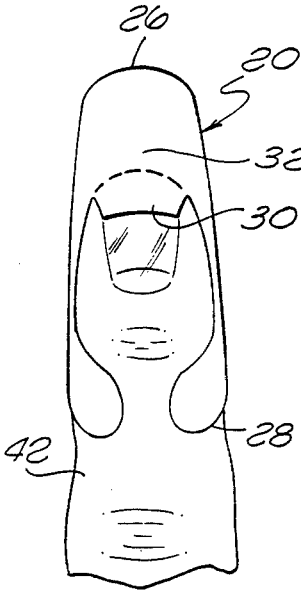
FIG. 3
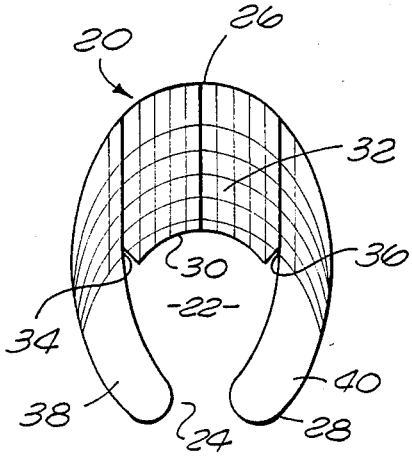
FIG. 4
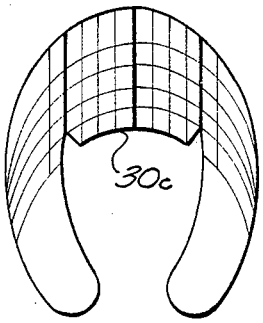
FIG. 5c

FORM FOR EXTENDING FINGERNAILS AND METHOD OF USING THE SAME

FIELD OF THE INVENTION

This invention relates to the treatment of nails, and more particularly, to a device for improving the physical and aesthetic characteristics of human fingernails by permitting the application of artificial fingernail prosthesis thereon.

BACKGROUND AND PRIOR ART OF THE INVENTION

The problem of maintaining presentable nails, and particularly fingernails, has always been of prime importance, particularly to women. This is particularly true where it is desired to enhance the appearance of the nail by increasing its length, and particularly in those instances where the nail to be so enhanced is broken or damaged, thin or brittle, or is incapable of being naturally developed to a desired length. Artificial nails have become a common part of everyday life to many women, and therefore, are of great commercial importance.

The conventional prior art form for the application of artificial fingernail prosthesis to the fingernails of humans for the purpose of creating an artificial fingernail which is extended beyond its natural length has been commercially available for a substantial period of time. The prior art form, as shown for example in FIG. 1, described in more detail below, was patented in the United States in 1957 (U.S. Pat. No. 2,799,282). It comprises, generally, a circular or oval shaped paper form with a circular or oval shaped cut-out and an open end, so that the overall configuration somewhat resembles a horseshoe shape with a broad platform area defining in part the shape of the artificial nail. One side of the form is coated with adhesive material.

However, there is a problem with the prior art artificial fingernail prosthesis forms in that as a result of their design they fail to conform to the finger, the nail bed, and to maintain a fixed, secured position adjacent certain stress points when the form is fitted to the finger and fingernail. The stress points on the attachment of the form to the finger, when they fail, result in the form attempting to retain its original flattened state, as compared with its curved state when applied to the finger. This makes it necessary for the person sculpting the artificial nails to take extra care to ensure that the prior art nail form does not flatten, at least until the artificial fingernail dries.

Further, in the case of bitten nails, or nails which are cut very short, the folds of skin on the sides of the nail bed are typically raised and protruding forward toward the tip of the finger. This makes it difficult, if not impossible, for conventional prior art forms to carefully and accurately abut the natural nail. As a result, there is an airspace between the form and the end of the nail, and in addition, there may be a gap at the corners of the artificial nail, all of which are crucial stress points of any sculptured nail. Obviously, if any of the stress points are thereby weakened, the length of time it takes before the artificial nail breaks off is substantially decreased thereby causing a decreased useful life of the nail treatment.

As shown in FIG. 1*a*, when a prior art form is applied to a shortened nail, an airspace or gap 10 exists between the end of the nail 12 and the concave end of the form 14. This is shown in FIGS. 1*a* and 1*b*. Sometimes glue is used to fill in the airspace 10. Other times the acrylic is simply layered over the nail including the airspace which is later sculptured to preference.

As can be seen, stress points 15 and 17, which are critical to the application of a good, strong artificial nail, barely contact the ends of the nail 16 and 18. As such, it is very difficult, if not impossible, to provide a good, solid anchor for the artificial fingernail in the event of a shortened or bitten nail.

As one mode of overcoming the problem of applying the prior art forms to shorten or bitten nails, glue is typically used to hold the nail form in place and cover a portion of the gap or airspace in order to attempt to effectively apply artificial nails to such situations. These and other problems are overcome with the use of the present invention artificial fingernail prosthesis form.

SUMMARY OF THE INVENTION

The present invention comprises a new design for artificial fingernail forms. The design is essentially horseshoe shaped, as is common with the prior art forms, the new aspect being a lip disposed on the concave end of the nail form. This lip permits the form to attach to the finger more securely than does the prior art form, and in addition, allows the form to maintain a more tubular shape at the tip, giving the artificial fingernail a more natural and desired shape instead of a flat, artificial look.

In the case of bitten or shortened nails, the application of the present invention is particularly useful because the lip which has cut-outs at either side, allows the raised and protruding portion of the skin at the sides of the nail bed to not interfere with the placement and securement of the form on the finger. The lip also extends toward the nail eliminating any space between the nail and form. As such, the airspace is eliminated and the crucial stress points are secured, thereby allowing the artificial fingernail to last substantially longer than artificial fingernail prosthesis used in the prior art.

Furthermore, because the artificial fingernail is more secure, less care is needed in ensuring that the form does not release from the finger prior to the artificial fingernail drying. This feature allows the person sculpting the fingernails to become more productive.

BRIEF DESCRIPTION OF THE DRAWINGS

FIGS. 1*a* through 1*c* illustrate a prior art fingernail prosthesis form.

FIG. 2 is a side view of the invented fingernail prosthesis form with the finger disposed therein.

FIG. 3 is a top view of the invented fingernail prosthesis form with the finger disposed therein.

FIG. 4 is a fingernail prosthesis of the present invention showing the application gridlines.

FIG. 5*a* through 5*c* are illustrations of small, medium and large fingernail prosthesis adapted for varying size fingers and applications.

DETAILED DESCRIPTION OF THE PREFERRED EMBODIMENT

Referring now to the drawings wherein like reference characters designate the same parts throughout the several views, and more particularly, FIGS. 2–5, there is illustrated the invented artificial fingernail form 20 embodying the present invention. The form 20 is substantially oval in shape with a generally oval cut-out portion 22 with an opening 24 at one end thereof. The oval shape may be slightly wider at the top end 26 than at the bottom end 28 in order to provide a large surface on which to apply the artificial fingernail material. One side of the form 20 is coated with a stick-on adhesive.

A number of different types of materials can be used for application to the form to make the artificial fingernails, which materials are readily commercially available. The materials are essentially acrylic-based.

The essence of the present invention is the lip 30 which extends downward from the platform 32 into the cut-out portion 22. This lip 30 is notched at 34 and 36 so that the lip is somewhat independent from the platform 32 and the sides 38 and 40 of the device. The lip 30 can be of varying sizes depending upon the specific use and the desirability of obtaining greater or lesser securement of the form 20 to the finger 42.

For example, in comparing FIGS. 5*a*, 5*b* and 5*c*, which each depict varying conventional sizes of the invented device, it is shown that the lip 30*a*, 30*b* and 30*c* becomes increasingly larger as the size of the entire form becomes larger. Small sizes, as shown in FIG. 5*a* are useful for small nail beds, pinkies or other small fingers in general, and are most used in connection with badly bitten nails wherein only a small nail bed is available. The medium size, as shown in FIG. 5*b*, is preferred for all around use including in intermediate nail sizes and somewhat bitten nails. The large size is useful for thumbs, large and intermediate size nail beds and is also useful for bitten nails.

As shown in FIGS. 2 and 3, the invented form adheres better to the finger than does the prior art form shown in FIGS. 1*a* through 1*c*. As can be best observed in FIGS. 1*a* and 1*b*, there is very little overlap between the form and the tip of the finger, particularly in light of the fact the finger is curved at the top near where the form is attached thereon. On the other hand, as best shown in FIG. 2, the lip 30 is well-attached to the finger and therefore provides a secure base for holding the form onto the finger. Additionally, in light of the fact that the forms are folded to curve around the finger, the lip of the present invention holds the form in place.

Also, the notches 34 and 36 allow for the ridge of skin formed particularly in connection with bitten nails, but also present in connection with normal nails, to be exposed without affecting the curvature of the form or its securement to the finger. Additionally, the lip 30, being independent from the arms 38 and 40, can fit underneath the fingernail to a greater or lesser extent, even in the case of bitten nails, so there is no gap or airspace between the form and the natural fingernail. As such, a unitary and uniform surface is provided for the application of the artificial finger nail.

As particularly shown in FIG. 4, the invention preferably comprises guidelines to allow the person sculpting the nail to accurately apply the artificial nail in the desired proportions. These guidelines, to a greater or lesser extent, can be found in general in the prior art.

In use, the invented form is applied so that the lip 30 is disposed under the fingernail, or as close to the nail bed as possible and the arms 38 and 40 are wrapped around the finger. The adhesive on the fingernail form 20, particularly at the lip 30 and on arms 38 and 40 secure the fingernail form to the fingernail and finger. Thereafter, the desired artificial fingernail material, which generally comprises polymethacrylate and other materials, all of which are commercially available, are applied to the fingernail and the form to a desired shape and size. Of course, the appropriate sized fingernail form must be selected, depending upon the size of the finger and other characteristics as discussed above.

The entire device can be die cut. Preferably, the forms are made of a paper or plastic-type material and are adhesive on one side, which side does not have the gridlines.

It should be understood by a person of ordinary skill in the art that the invention is not limited to the specific arrangements shown in the drawings presented herewith and disclosed herein, and that changes or modifications may be made within the scope of the appended claims.

We claim:

1. An artificial fingernail prosthesis form of the type having a generally horseshoe shape and having a platform member at one end of said form for providing a surface for the application of an artificial nail thereon and a pair of slightly curved arms which are spaced slightly apart from each other at the other end of said form, said form having adhesive material on one side thereof, the improvement comprising a lip member disposed on a portion of the platform member adjacent to the other end and being adapted to attach to the fingernail bed of a human finger, said lip member comprising on each end thereof a cutaway notch means separating said lip member from said curved arms of said horseshoe shape, said cutaway notch means being adapted to accommodate folds of skin on the sides of human nails.

2. The artificial fingernail prosthesis form of claim 1, wherein said lip member is radially curved along its surface adjacent said other end.

3. The artificial fingernail prosthesis form of claim 1, wherein said notch means are triangular.

4. The artificial fingernail prosthesis form of claim 1, further comprising gridlines on the surface not comprising the adhesive material.

5. The artificial fingernail prosthesis form of claim 1, wherein said form is provided in a plurality of sizes to accommodate different sizes of fingers.

6. A method of forming artificial nails comprising:

applying to a finger an artificial fingernail prosthesis form of the type having a generally horseshoe shape and having a platform member at one end of said form for providing a surface for the application of an artificial nail thereon and a pair of slightly curved arms which are spaced slightly apart from each other at the other end of said form, said form having adhesive material on one side thereof, and a lip member disposed on a portion of the platform member adjacent to the other end, said lip member being adapted to attach to the fingernail bed of a human finger and having cutaway notch means on each side thereof; disposing the lip member adjacent and under a fingernail; accommodating the nail bed of a finger with said cutaway notch means;

applying an artificial fingernail material to said fingernail and said form to a desired shape;

allowing said artificial fingernail material to dry; and removing said form from said finger and artificial fingernail.

* * * * *